US007810571B2

(12) United States Patent
Beall

(10) Patent No.: US 7,810,571 B2
(45) Date of Patent: Oct. 12, 2010

(54) DOWNHOLE LUBRICATOR VALVE

(75) Inventor: Clifford H. Beall, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 11/595,596

(22) Filed: Nov. 9, 2006

(65) Prior Publication Data

US 2008/0110632 A1 May 15, 2008

(51) Int. Cl.
*E21B 34/00* (2006.01)

(52) U.S. Cl. ..... 166/334.2; 166/323; 166/332.3

(58) Field of Classification Search ..... 166/332.3, 166/334.2, 323
See application file for complete search history.

(56) References Cited

U.S. PATENT DOCUMENTS

| | | | | |
|---|---|---|---|---|
| 3,886,967 | A | 6/1975 | Nelson | |
| 3,971,438 | A | 7/1976 | Crowe | |
| 4,103,744 | A | 8/1978 | Akkerman | |
| 4,130,166 | A | 12/1978 | Akkerman et al. | |
| 4,197,879 | A | 4/1980 | Young | |
| 4,289,165 | A | 9/1981 | Fredd | |
| 4,293,038 | A | 10/1981 | Evans | |
| 4,325,434 | A | 4/1982 | Roberts | |
| 4,332,267 | A | 6/1982 | Evans | |
| 4,368,871 | A | 1/1983 | Young | |
| 4,406,328 | A | 9/1983 | Brooks | |
| 4,415,037 | A | 11/1983 | Brooks | |
| 4,446,922 | A | 5/1984 | Bowyer et al. | |
| 4,449,587 | A | 5/1984 | Rodenberger et al. | |
| 4,467,870 | A | 8/1984 | Langham | |
| 4,475,598 | A | 10/1984 | Brakhage, Jr. et al. | |
| 4,476,933 | A | 10/1984 | Brooks | |
| 4,519,576 | A | 5/1985 | Winegeart | |
| 4,522,370 | A | 6/1985 | Noack et al. | |
| 4,569,397 | A | 2/1986 | Brakhage, Jr. et al. | |
| 4,627,492 | A * | 12/1986 | MacLaughlin | 166/250.08 |
| 5,417,405 | A | 5/1995 | Stephan et al. | |
| 5,564,675 | A | 10/1996 | Hill et al. | |
| 5,865,246 | A | 2/1999 | Brown | |
| 6,109,352 | A | 8/2000 | Edwards et al. | |

(Continued)

OTHER PUBLICATIONS

Svendsen, Ove B., et al., "A Successful Completion/Perforation by Use of a Downhole Lubricator Valve: A Case Study from the Srir Field, Danish Sector, North Sea", SPE 63113, Oct. 2003, 1-7.

(Continued)

*Primary Examiner*—William P Neuder
*Assistant Examiner*—Nicole A Coy
(74) *Attorney, Agent, or Firm*—Steve Rosenblatt

(57) ABSTRACT

A ball type downhole lubricator valve features a ball rotating on its axis to open or close with control line pressure to an actuating piston. The ball is also shiftable to a locked open position. A cage surrounds the ball and retains opposed seats to it. The cage is made from one piece and tangential holes are drilled and tapped before the piece is longitudinally split with a wire EDM cutting technique. Fasteners to rejoin the cut halves properly space them to the original one piece internal dimension. Auxiliary tools allow determination of spacing of internal components so that a desired spring preload on the seats against the ball can be achieved.

13 Claims, 9 Drawing Sheets

U.S. PATENT DOCUMENTS

| | | | |
|---|---|---|---|
| 6,223,824 | B1 | 5/2001 | Moyes |
| 6,691,785 | B2 | 2/2004 | Patel |
| 6,695,286 | B1 | 2/2004 | Florio et al. |
| 6,708,946 | B1 | 3/2004 | Edwards et al. |
| 2001/0045285 | A1 | 11/2001 | Russell |
| 2002/0040788 | A1 | 4/2002 | Hill, Jr. et al. |
| 2006/0272825 | A1* | 12/2006 | Royer ..... 166/373 |

OTHER PUBLICATIONS

Heijnen, W.H.P.M., et al., "Subsurface Safety Valve Developments for Gaswells", SPE 19283-1, Sep. 1989, 6 pages.

* cited by examiner

DOWNHOLE LUBRICATOR VALVE

FIELD OF THE INVENTION

The field of the invention relates to downhole lubricator valves that allow a string to be made up in a live well by isolation of a lower portion of it and more particularly to features regarding such valves relating to locking them, assembling them and component fabrication techniques.

BACKGROUND OF THE INVENTION

Lubricator valves are valves used downhole to allow long assemblies to be put together in the well above the closed lubricator valve with well pressure further below the closed lubricator valve. These valves are frequently used in tandem with sub-surface safety valves to have redundancy of closures against well pressures below.

Lubricator assemblies are used at the surface of a well and comprise a compartment above the wellhead through which a bottom hole assembly is put together with the bottom valve closing off well pressure. These surface lubricators have limited lengths determined by the scale of the available rig equipment. Downhole lubricators simply get around length limitations of surface lubricators by using a lubricator valve downhole to allow as much as thousands of feet of length in the wellbore to assemble a bottom hole assembly.

In the past ball valves have been used as lubricator valves. They generally featured a pair of control lines to opposed sides of a piston whose movement back and forth registered with a ball to rotate it 90 between an open and a closed position. Collets could be used to hold the ball in both positions and would release in response to control pressure in one of the control lines. An example of such a design can be seen in U.S. Pat. Nos. 4,368,871; 4,197,879 and 4,130,166. In these patents, the ball turns on its own axis on trunnions. Other designs translate the ball while rotating it 90 degrees between and open and a closed position. One example of this is the 15K Enhanced Landing String Assembly offered by the Expro Group that includes such a lubricator valve. Other designs combine rotation and translation of the ball with a separate locking sleeve that is hydraulically driven to lock the ball turning-and shifting sleeve in a ball closed position as shown in U.S. Pat. No. 4,522,370. Some valves are of a tubing retrievable style such as Halliburton's PES® LV4 Lubricator Valve. Lock open sleeves that go through a ball have been proposed in U.S. Pat. No. 4,449,587. Other designs, such as U.S. Pat. No. 6,109,352 used in subsea trees have a rack and pinion drive for a ball and use a remotely operated vehicle (ROV) to power the valve between open and closed positions claiming that either end positioned is a locked position but going on to state that the same ROV simply reverses direction and the valve can reverse direction.

What is lacking and addressed by the present invention is a more elegant solution to a downhole ball type lubricator valve. One of the features is the ability to translate the ball for the purpose of locking open a ball that normally rotates between open and closed on its own axis. Another feature is a method of manufacturing parts that must be longitudinally split so that they retain the original bore dimension despite the wall removal occasioned by longitudinally splitting the part. Yet another feature is the ability to assemble components to a given overall dimension so as to accurately set preload on biased seats that engage the ball. These and other features of the present invention will be more readily apparent to those skilled in the art from a review of the preferred embodiment and associated drawings that are described below while recognizing that the full scope of the invention is determined by the claims.

SUMMARY OF THE INVENTION

A ball type downhole lubricator valve features a ball rotating on its axis to open or close with control line pressure to an actuating piston. The ball is also shiftable to a locked open position. A cage surrounds the ball and retains opposed seats to it. The cage is made from one piece and tangential holes are drilled and tapped before the piece is longitudinally split with a wire EDM cutting technique. Fasteners to rejoin the cut halves properly space them to the original one piece internal dimension. Auxiliary tools allow determination of spacing of internal components so that a desired spring preload on the seats against the ball can be achieved.

DETAILED DESCRIPTION OF THE PREFERRED EMBODIMENT

Figure 1:
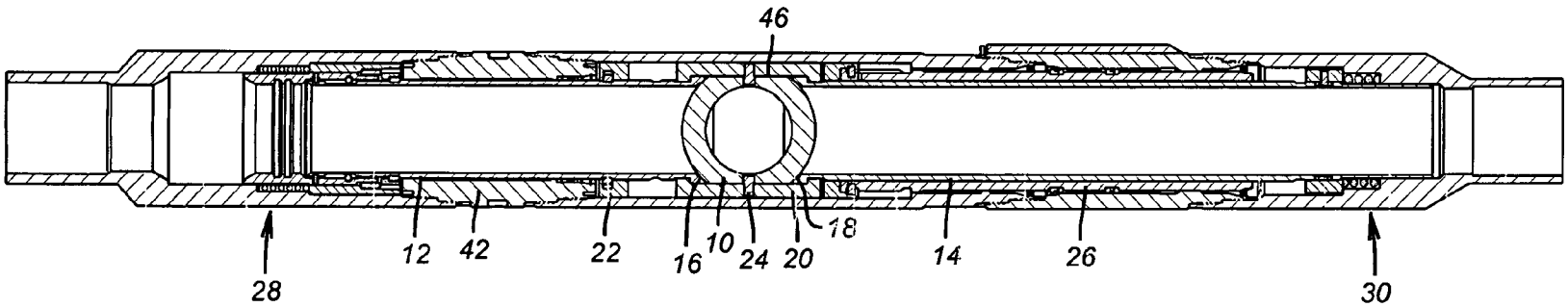
FIG. 1 is a section view of the entire lubricator valve.

FIG. 1 illustrates the layout of the main components to show their position relative to each other with the ball 10 in the center and in the closed position. Sleeve 12 is above ball 10 and sleeve 14 is below ball 10. These sleeves respectively form seats 16 and 18 that are held against ball 10 by a cage 20. Cage 20 is shown in perspective in FIG. 9. A slide 22 extends through cage 20 and registers with ball 10 to rotate it between the open and closed position on trunnions 24. A piston 26 is responsive to control line pressure to reciprocate the slide 22 to operate ball 10. A lock open assembly 28 is disposed near the top of the tool while the preload adjustment mechanism 30 is located near the opposite end. Using this basic locating of the major components of the valve, the other FIGS. will now be used to bring out additional details and explain the basic operation.

Figure 3:
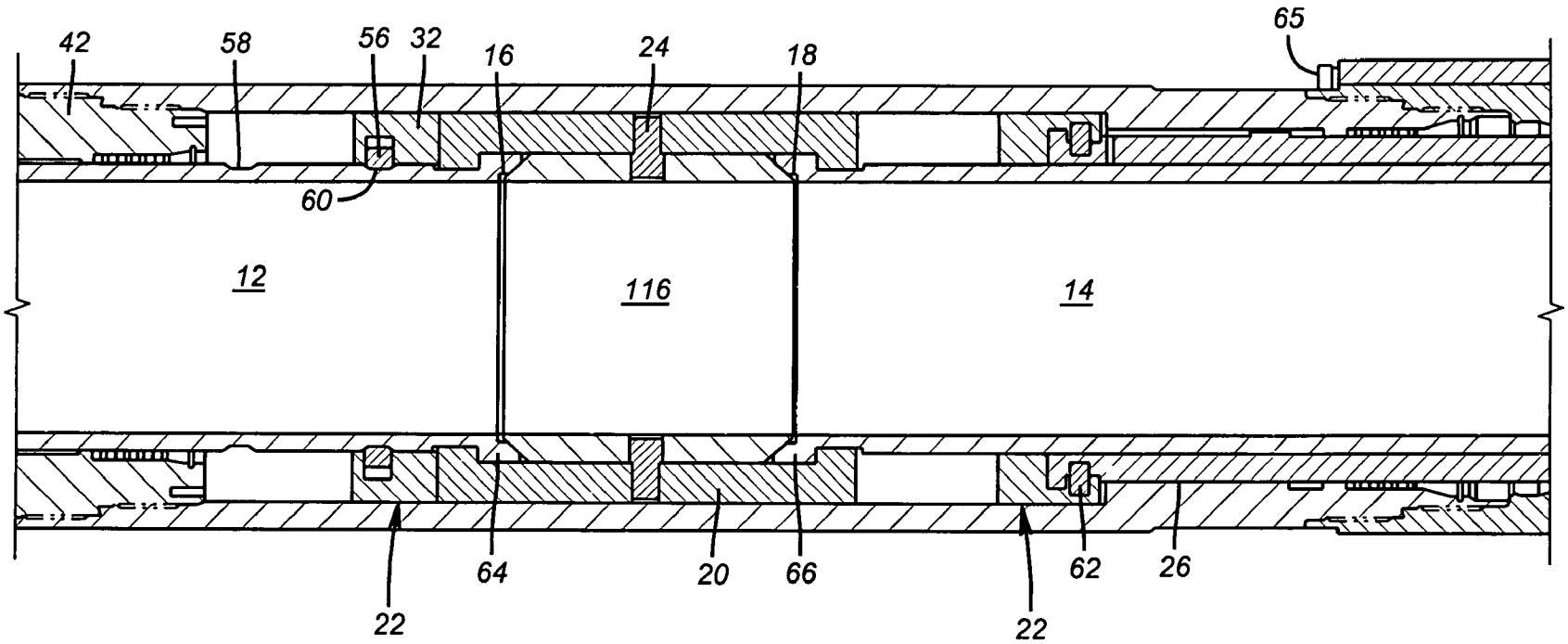
FIG. 3 is a larger view of the middle of the valve from FIG. 1 showing the ball open.
Figure 6:
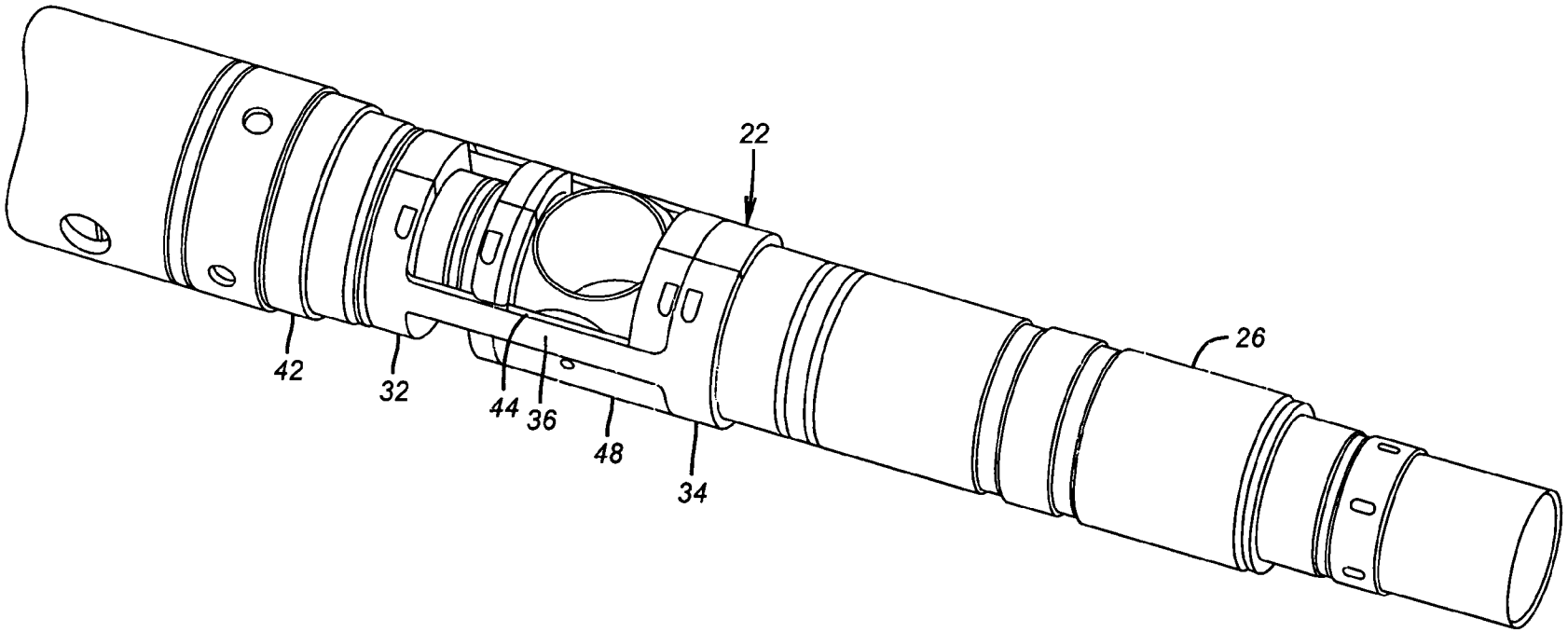
FIG. 6 is a perspective view of the section views shown in FIGS. 4 and 5.
Figure 9:
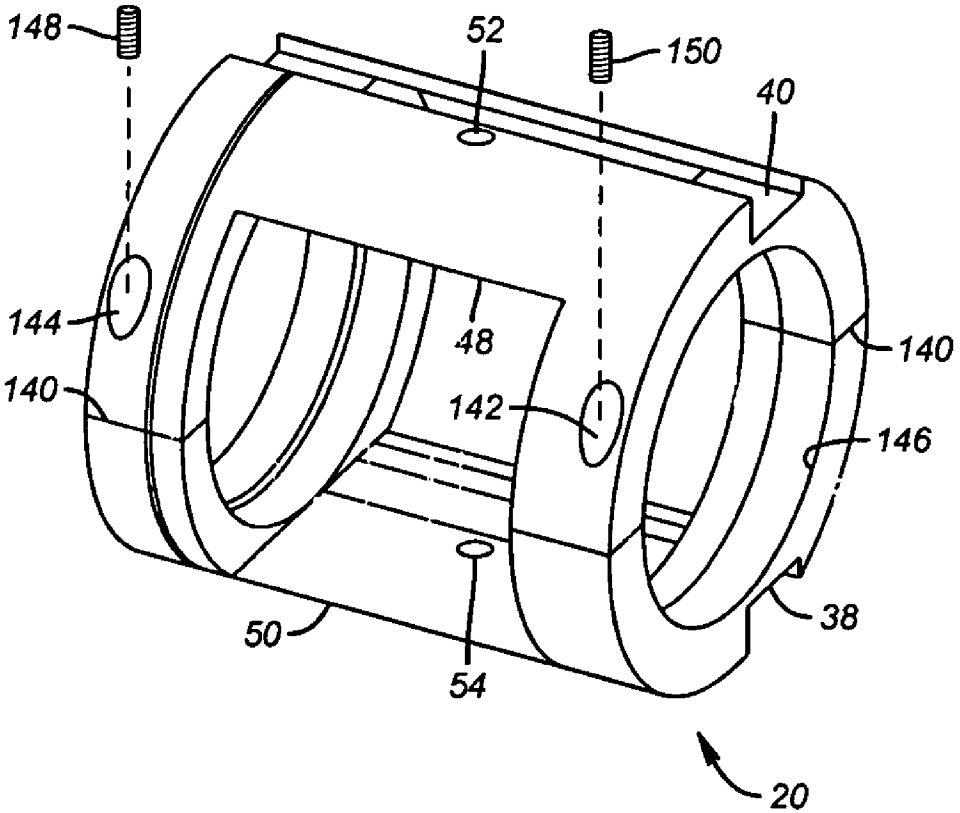
FIG. 9 is a perspective of the cage that surrounds the ball and is longitudinally split.

FIG. 6 can be used to appreciate how the ball 10 is rotated 90 degrees between the closed position shown in FIG. 6 and the open position shown in section in FIG. 3. Piston 26 operates like many pistons known in the art and used in downhole valves. A pair of control lines (not shown) are run from the surface to opposing piston face areas on piston 26 to urge it to move in opposed directions. The piston 26 is secured to the slide 22 for tandem movement. Slide 22 has an upper ring 32 and a lower ring 34 connected by arms 36, one of which is visible in FIG. 6. Looking at FIG. 9 it can be seen that the cage has longitudinal slots 38 and 40 that accept the arms 36 of slide 22. Referring to FIGS. 1 and 6 it can be seen that slide 22 is at the end of its uphole stroke as it has contacted the mandrel 42. Ball 10 has opposed angled exterior slots 44 one of which is partially in view in FIG. 6. The slots 44 are parallel to each other on opposed flats 46 better seen in FIG. 1. Flats 46 on ball 10 abut arms 48 and 50 of cage 20 as best seen in FIGS. 6 and 9. Holes 52 and 54 accept trunnions 24 that extend into ball 10 to allow it to rotate on its own axis. Cage 22 does not move but when slide 22 is moved by piston 26 the result is rotation of ball 10 on its own axis. This happens because arms 36 have inwardly facing pins (not shown) that register with slots 44 in ball 10 off center from trunnions 24 to induce rotation of ball 10.

Figure 4:
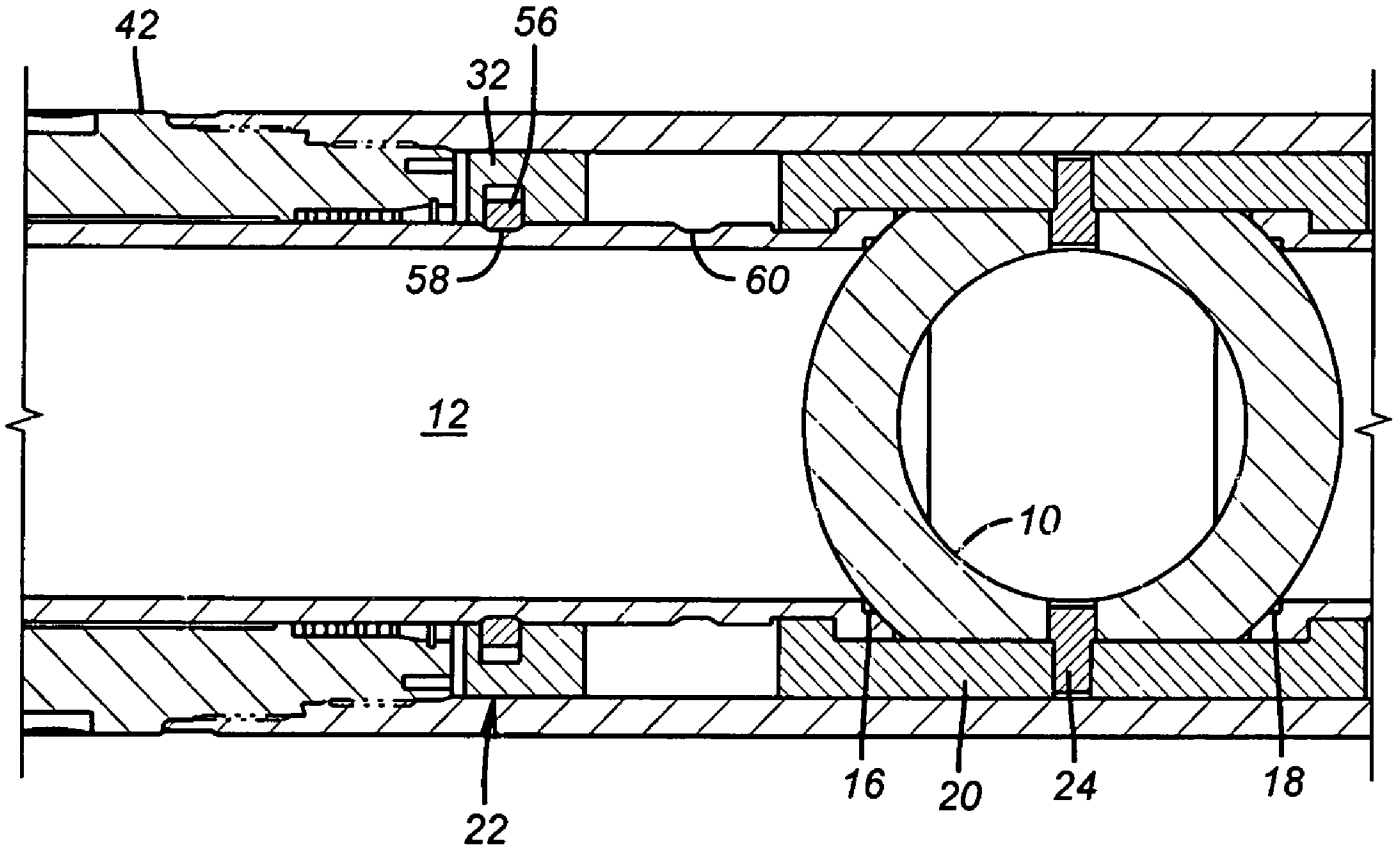
FIG. 4 is an alternate view to FIG. 3 showing the ball closed.

To better see this movement, FIGS. 3 and 4 need to be compared. FIG. 4 shows the ball 10 in a closed position and upper ring 32 close to mandrel 42 but not in contact. This is because a snap ring 56 registers with slot 58 on sleeve 12 to hold the ball 10 in a closed position until enough pressure is exerted on piston 26 to pop the snap ring 56 out of groove 58 until it registers with groove 60 to define the open position of FIG. 3. Again, in FIG. 4 during normal opening and closing of the ball 10, the only moving part except ball 10 shown in that FIG. is slide 22 with ring 56. FIG. 3 shows the fully open position of ball 10 with ring 56 registering with groove 60. Slide 22 may optionally contact cage 20 at this time. FIG. 3 also shows piston 26 attached to slide 22 with a fastener 62. One of the control line connections 64 to operate piston 26 is also shown in FIG. 3. FIG. 3 also shows that sleeves 12 and 14 respectively form flanges 64 and 66 and how the cage 20 retains those flanges together against ball 10. Seals 16 and 18 respectively are disposed in flanges 64 and 66 for circumferential sealing contact with ball 10 as it rotates between the open and the closed positions of FIGS. 3 and 4.

Figure 5:
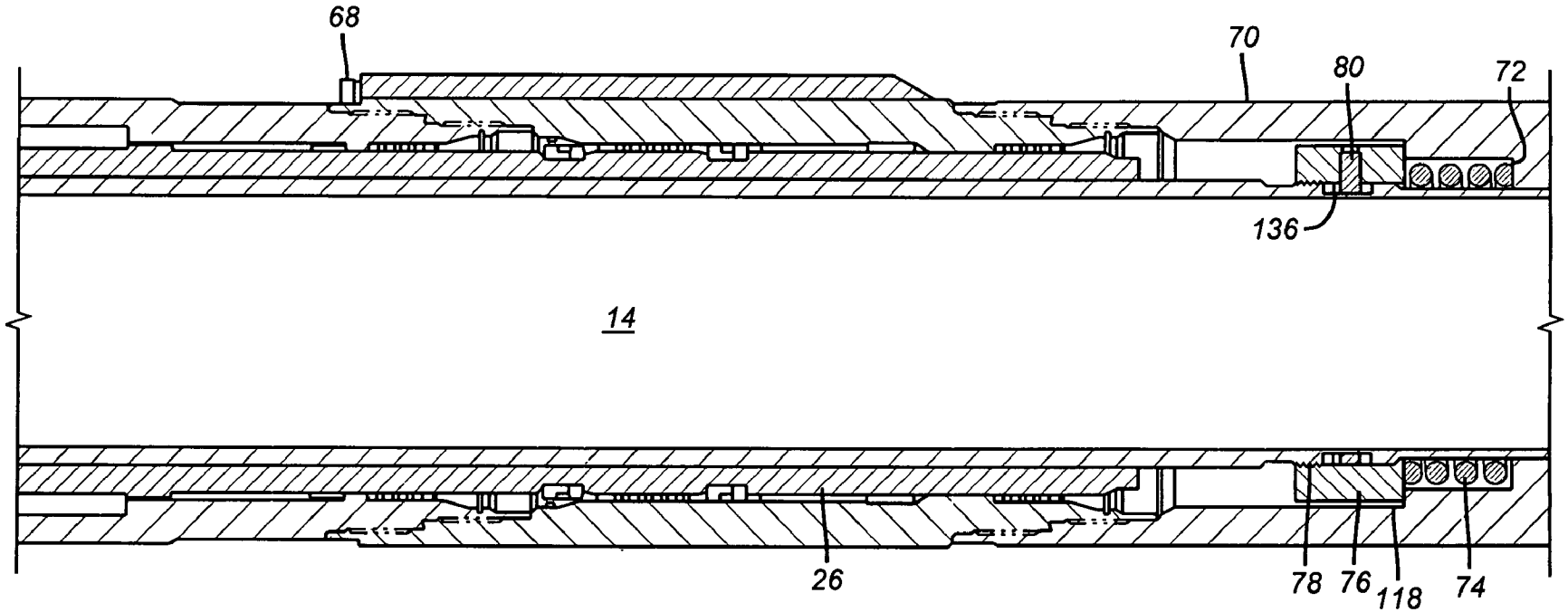
FIG. 5 is a larger view of the lower end of the valve of FIG. 1.

Looking now at FIG. 5, the lower end of the sleeve 14 can be seen as well as another control line connection 68 that is used to urge piston 26 in an opposite direction from pressure applied to connection 64 shown in FIG. 3. A bottom sub 70 has a shoulder 72 on which a spring 74 is supported. Spring 74 pushes on ring 76 that is attached to sleeve 14 with a thread 78. A pin 80 locks the position of ring 76 after that position is initially determined in a procedure that will be explained below. In essence, spring 74 is a preload spring on an assembly that begins with ring 76 and extends to the upper end of the valve shown in FIG. 2.

Figure 2:
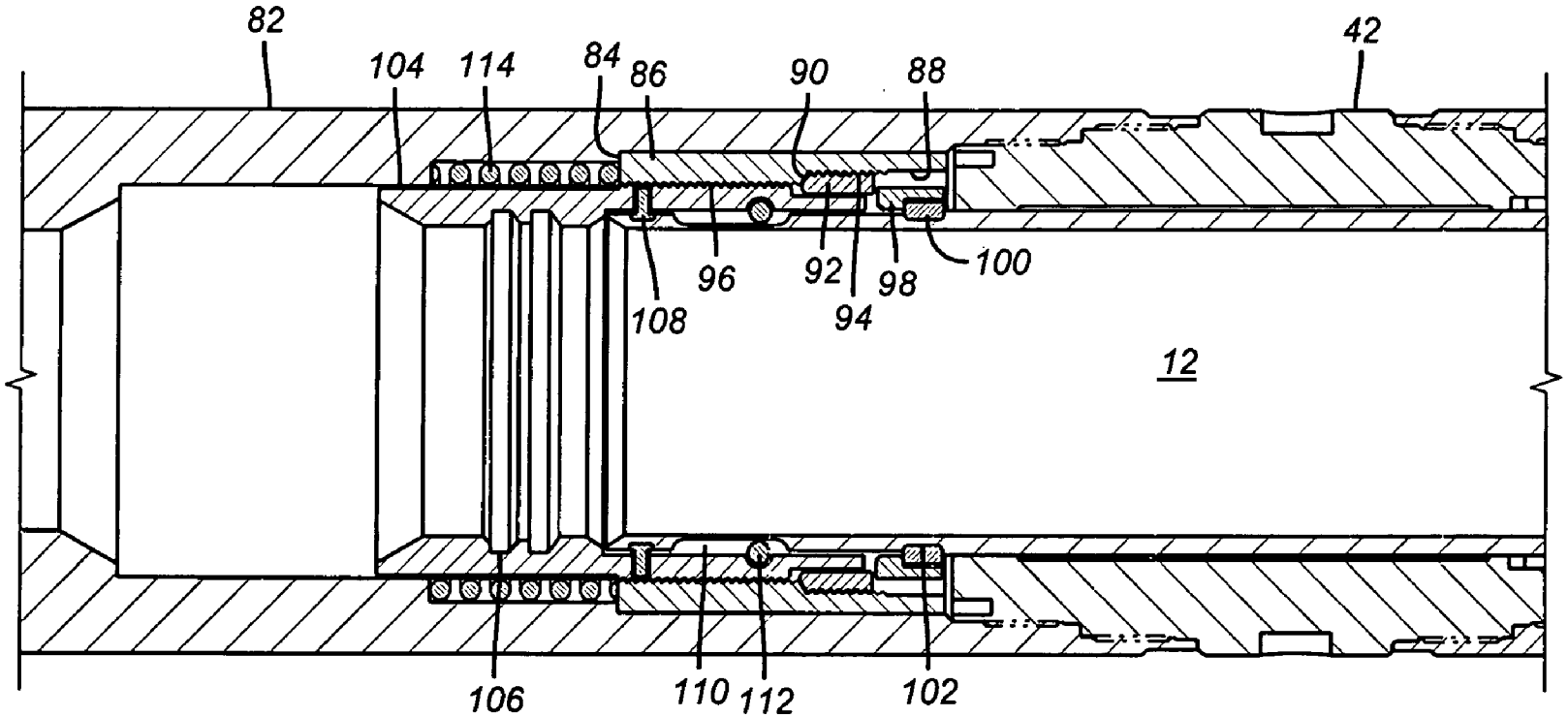
FIG. 2 is a larger view of the top end of the valve of FIG. 1.

Referring to FIG. 2 the lock open feature will be described. Sleeve 12 is ultimately selectively retained by top sub 82. Shoulder 84 contains fixed ratchet ring 86 against mandrel 42. Ring 86 has an undercut 88 defining taper 90. Ring 92 initially sits in undercut 88. It has ratchet teeth 94 that, in the position of FIG. 2 are offset from ratchet teeth 96 on ring 86. Ring 92 bears on retainer ring 98 which, in turn, captures split ring 100 in groove 102 of sleeve 12. Because of the relation of these parts, sleeve 12 is held down against ball 10 and against the uphole force on sleeve 14 from spring 74 (see FIG. 5). Locking collar 104 has one or more internal grooves 106 for engagement with a tool (not shown) that will ultimately pull the collar 104 uphole. A shear pin 108 initially secures the collar 104 to the sleeve 12. Sleeve 12 has a groove 110 that eventually registers with tangential pins 112 extending from collar 104. Collar 104 initially retains ring 92 in undercut 88. In operation, the collar 104 is pulled up with a tool (not shown) to break the shear pin 108. As the collar then moves up, tangential pins 112 ride in groove 110 until hitting the top of it at which time the collar 104 moves in tandem with sleeve 12. In the meantime, collar 104 moves uphole from ring 92 allowing it to collapse inwardly to clear taper 90. When pins 112 register with the top of groove 110 and the sleeve 12 is moving with collar 104, ring 100 in groove 102 of sleeve 12 takes with it ring 98 which, in turn now can push ring 92 beyond taper 90 so that ratchet teeth 94 move into engagement with ratchet teeth 96 on ratchet ring 86. The uphole movement described above continues until sleeve 12 hits a travel stop. This happens in two ways depending on the position of ball 10 when sleeve 12 is being pulled up. If the ball 10 is open, as shown in FIG. 3, flange 64 pulls up cage 20 as well as slide 22 which was registered with sleeve 12 at groove 60. The ball 10 comes up with cage 20 because they are connected at trunnions 24. The ball 10 does not rotate because there is no relative movement between the slide 22 and the cage 20. Motion of sleeve 12 stops when ring 32 hits mandrel 42 and that position is held locked by the ratchet teeth engagement of teeth 94 and 96. On the other hand, if ball 10 is in the closed position of FIG. 4, the sleeve 12 will bring up the cage 20 and move it relatively to slide 22. This happens because at the onset of movement of sleeve 12 the upper ring 32 of slide 22 is already close to mandrel 42 and fairly quickly hits it as the sleeve 12 comes up. Further uphole movement of sleeve 12 pulls the cage 20 relative to the slide 22 which causes the pins in slide 22 to rotate ball 10 to open as they register with slots 44 in ball 10. When the cage 20 comes against already stopped ring 32 of the slide 22 uphole motion stops and the position is again locked in by engaging teeth 94 and 96.

Figure 7:
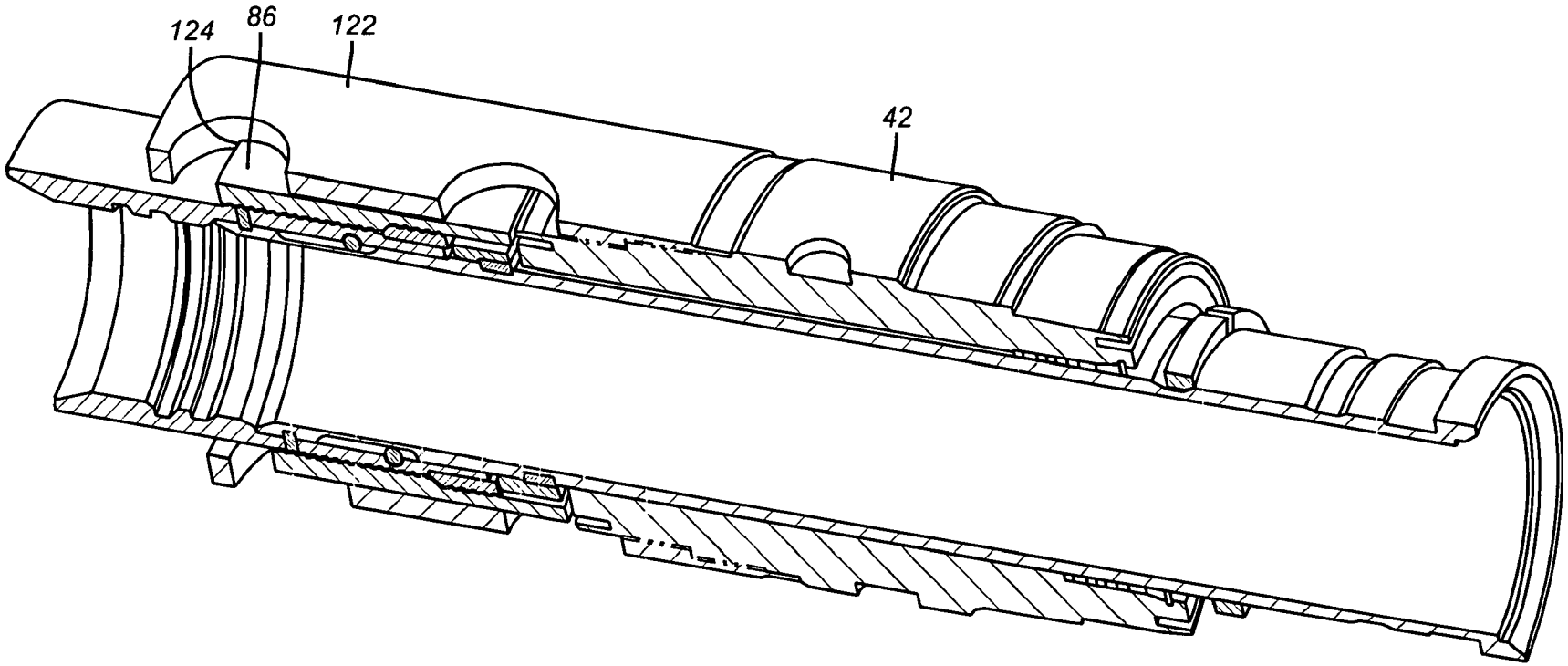
FIG. 7 shows the top end of the valve in FIG. 1 during assembly to get proper spacing of internal components.
Figure 8:
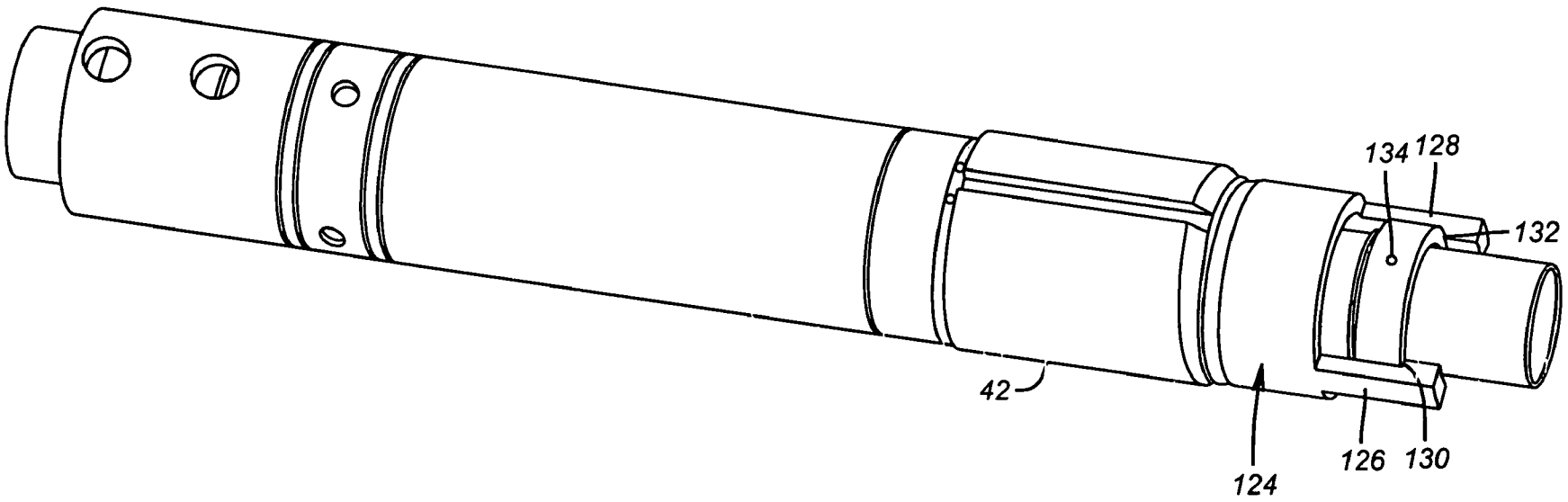
FIG. 8 shows the lower end of the valve in FIG. 1 during assembly to get proper spacing of internal components.

Referring again to FIG. 2 a spring 114 can optionally be used to push on ring 86 and through the other parts described before downwardly on sleeve 12 which in turn pushes on ball 10 and sleeve 14 which is in turn biased uphole by spring 74 pushing on ring 76 that is attached at thread 78 to sleeve 14. This assembly keeps the cage 20 in a fixed position for normal operation of the ball 10 and when ring 104 in FIG. 2 is pulled allows the cage 20 to translate uphole to get the lock open feature with a fully open bore 116 extending through the ball 10 and continuing through sleeves 12 and 14 above and below. As those skilled in the art will appreciate the assembly of parts from shoulder 84 at the upper end to shoulder 118 at the lower end each have their own tolerance and the adjustment available for the position of ring 76 on thread 78 is fairly minimal. As a result, the total dimension of the parts between shoulders 84 and 118 can be determined and the position of ring 76 necessary to give the right preload to the assembled parts also determined before final assembly of top sub 82 and bottom sub 70. FIGS. 7 and 8 show this technique.

Instead of assembling top sub 82 and spring 114 to mandrel 42 an upper gauge 122 is assembled to mandrel 42. When fully threaded on, a shoulder 124 hits ring 86 in the exact spot that shoulder 84 from top sub 82 would normally engage it. At the same time at the lower end in FIG. 8 instead of putting on bottom sub 70, spring 74 or pin 80, a lower gauge 124 is threaded on to mandrel 42. Lower gauge 124 has a pair of arms 126 and 128 that respectively have shoulders 130 and 132 that wind up exactly where shoulder 118 would be when bottom sub 70 is screwed on. Because of the open gaps between arms 126 and 128 there is access to adjustment ring 76 and it can be moved up or down on thread 78 as long as pin 80 is not assembled. Ring 76 is turned to bottom on shoulders 130 and 132 and then raised by rotation enough to allow an opening 134 to align with a recess 136 (see FIG. 5) so that ring 76 has its position fixed as close as possible to shoulder 118 when the bottom sub 70 is assembled with spring 74. Similarly, the upper gauge 122 (FIG. 7) is first removed and replaced with top sub 82 and spring 114 (FIG. 2). When the bottom sub 70 and spring 74 get screwed on, spring 74 will have the needed preload since despite the accumulation of tolerances of all the assembled parts the actual surface of ring 76 is determined as it related to spring 74 for the desired preload.

Referring now to FIG. 9 the cage 20 is illustrated as fully assembled. Since it needs to straddle ball 10 and flanges 64 and 66 (FIG. 3) it needs to be made into two pieces. The technique for making this piece or, for that matter, other pieces that need to be made in two pieces to be assembled over yet other pieces, is to make a longitudinal cut 140. Before doing that, all the machining shown in FIG. 9 is done including bores 142 and 144 on one side and similar bores on the other side (not visible) that go though where longitudinal cut 140 will be made. Again, before the cut is made, the bores 142 and 144 are tapped. Thereafter the cut 140 is made by a wire EDM technique. This known technique removes a part of the wall away where the cut is made. Thus, after the cut halves are pushed together, their inside diameter 146 will be smaller than it was before the cut. However, the pitch of the tapped thread and the matching thread on the studs 148 and 150 when screwed in to bridge the cut 140 will, because of the thread pitch separate the halves at cut 140 just enough to compensate for the amount of wall removed during the cut so that when fully assembled the original one piece diameter 146 that was there before the cut is again present. While the wire EDM removes only a few thousandths of an inch out of the wall to make the longitudinal cut the result is still a change in the internal bore dimension. This technique of drilling and tapping before a longitudinal cut with wire EDM allows the original bore dimension to be regained while holding the cut halves together.

Those skilled in the art will recognize that the ball type lubricator valve can be normally operated with control line pressure that moves piston 26 in opposed directions to rotate ball 10 on its own axis for 90 degrees to the open and closed positions. An indexing feature holds the open and closed positions when they are attained. The valve can be locked open from either the open position or the closed position by freeing the upper sleeve 12 to move and lifting it until it ratchet locks with the ball 10 in the open position while maintaining a full bore through the valve. While a ratchet lock is illustrated other locking devices such as dog through windows, collets or other equivalent devices are also contemplated. It should be noted that translation of ball 10 is only employed when attempting to lock it open. It should be noted that parts can be reconfigured to alternatively allow the ball 10 to be locked closed as an alternative.

Yet another feature of the lubricator valve is the preloading of the internal components and the ability to gauge the dimension of the internal components before mounting the top and bottom subs with the spring or springs that provide the preload so the proper amount of preload can be applied. Yet another feature is a way of making longitudinally split parts so that they retain their original internal dimension despite removal of a part of the wall for a cutting operation using the drill and tap technique before longitudinal cutting by wire EDM and then regaining near the original spacing in the joined halves relying on the pitch of the tapped thread and the fastener inserted in the bore and spanning the longitudinal cut. In this particular tool the cage 20 and slide 22 can be made with this technique. The technique has many other applications for longitudinally split parts with internal bores that must be maintained despite wall removal from a cutting process like wire EDM.

While the preferred embodiment has been set forth above, those skilled in art will appreciate that the scope of the invention is significantly broader and as outlined in the claims which appear below.

I claim:

1. A downhole valve, comprising:

a housing having a passage therethrough:

a ball having a single bore therethrough rotatably mounted to rotate, without translation, on its axis to align and misalign said bore with said passage;

said axis of said ball mounted in said housing for selective translation with respect to said housing apart from said rotation.

2. The valve of claim 1, further comprising:

opposed seats on sleeves, said seats abutting said ball under a bias force.

3. The valve of claim 2, wherein:

at least one of said sleeves is selectively secured to said housing.

4. The valve of claim 3, wherein:

said sleeve is lockable to said housing after being unsecured and shifted.

5. The valve of claim 2, further comprising:

a movably mounted adjustment ring on one of said sleeves to adjust spacing adjacent one end of one of said sleeves with seats, after assembly in said housing, to a shoulder in said housing so as to put a predetermined preload on a biasing member bearing on said adjustment ring and said shoulder.

6. A downhole valve, comprising:

a housing having a passage therethrough:

a ball having a bore therethrough rotatably mounted to rotate, without translation, on its axis to align and misalign said bore with said passage;

said axis of said ball mounted in said housing for selective translation apart from said rotation;

opposed seats on sleeves, said seats abutting said ball under a bias force;

at least one of said sleeves is selectively secured to said housing;

said sleeve is lockable to said housing after being unsecured and shifted;

said seats are retained to said ball by a cage;

a slider is movably mounted for relative movement with respect to said cage;

said ball is pivotally mounted to said cage;

said slider registers with said ball off center to said pivotal mounting of said ball to turn it between an open and closed position;

wherein selectively moving one of said sleeves to a locked position retains said ball in the open position if it was already open at the onset of sleeve movement or moves said ball to said open position from a closed position by relative movement between said cage and slide due to sleeve movement.

7. The valve of claim 6, wherein:

said selective securing of a sleeve to said housing comprises a lock ring in a first position that is initially supported by a shiftable sleeve, said shiftable sleeve is connected to a said sleeve having said seat with a lost motion feature, whereupon taking out the lost motion undermines and translates said lock ring to engage a one way ratchet on said housing.

8. The valve of claim 6, wherein:

at least one of said slider and said cage are formed from a single piece and longitudinally split with tapped bores already straddling said split such that an inserted fastener engaging a respective tapped bore spaces said split parts by an amount that compensates for material removed during said longitudinal splitting.

9. The valve of claim 8, wherein:

said parts are split by wire EDM.

10. The valve of claim 6, wherein:

said locking of said sleeve with said ball in the open position does not reduce the dimension of said bore in said ball or said passage in said housing.

11. The valve of claim 6, further comprising:

a piston connected to said slide further comprising connections on said housing for pressure application to drive said piston and said slide in tandem in opposed directions.

12. A downhole valve, comprising:

a housing having a passage therethrough:

a ball having a bore therethrough rotatably mounted to rotate, without translation, on its axis to align and misalign said bore with said passage;

said axis of said ball mounted in said housing for selective translation apart from said rotation;

opposed seats on sleeves, said seats abutting said ball under a bias force;

a movably mounted adjustment ring on one of said sleeves to adjust spacing adjacent one end of one of said sleeves with seats, after assembly in said housing, to a shoulder in said housing so as to put a predetermined preload on a biasing member bearing on said adjustment ring and said shoulder;

said adjustment ring is on a different sleeve with a seat than said sleeve with a seat that is selectively secured to said housing.

13. A downhole valve, comprising:

a housing having a passage therethrough:

a ball having a bore therethrough rotatably mounted to rotate, without translation, on its axis to align and misalign said bore with said passage;

said axis of said ball mounted in said housing for selective translation apart from said rotation;

opposed seats on sleeves, said seats abutting said ball under a bias force;

a movably mounted adjustment ring on one of said sleeves to adjust spacing adjacent one end of one of said sleeves with seats, after assembly in said housing, to a shoulder in said housing so as to put a predetermined preload on a biasing member bearing on said adjustment ring and said shoulder;

a temporary portion of said housing with an opening giving access to said adjustment ring while providing a shoulder in the same location as said shoulder in said housing to allow said adjustment ring to be located and locked to its sleeve and be in the position needed for preload on said sleeves with seats after said temporary portion of said housing is replaced and said biasing member is bearing on said shoulder in said housing and said adjustment ring.

* * * * *